United States Patent [19]

Fahrion

[11] Patent Number: 4,659,048

[45] Date of Patent: Apr. 21, 1987

[54] SUPPORTING DEVICE FOR A DATA DISPLAYING UNIT

[76] Inventor: Otmar Fahrion, Iltisweg 31, D-7014 Kornwestheim, Fed. Rep. of Germany

[21] Appl. No.: 729,941

[22] Filed: May 2, 1985

[30] Foreign Application Priority Data

May 8, 1984 [DE] Fed. Rep. of Germany ..... 3416859

[51] Int. Cl.[4] ..... E04G 3/00

[52] U.S. Cl. ..... 248/285; 108/102; 248/287; 248/298; 312/198; 403/61

[58] Field of Search ..... 248/285, 284, 286, 287, 248/291, 298, 480, DIG. 13; 108/102, 103, 140; 312/198; 403/61; 179/151, 146 R

[56] References Cited

U.S. PATENT DOCUMENTS

| | | | |
|---|---|---|---|
| 2,894,576 | 7/1959 | Williams | 248/480 X |
| 3,729,627 | 4/1973 | Littell | 248/298 X |
| 4,141,524 | 2/1979 | Corvese | 248/287 X |
| 4,305,563 | 12/1981 | Pregsson | 248/349 |
| 4,451,021 | 5/1984 | Merriss | 248/480 |

FOREIGN PATENT DOCUMENTS 2523828 9/1983 France .

*Primary Examiner*—Ramon O. Ramirez
*Attorney, Agent, or Firm*—Fred Philpitt

[57] ABSTRACT

A supporting device for a data display unit (32) consists of a base plate (26) which can be swivelled about a vertical axis (24) and on which a supporting plate (30), on which the data display unit (32) stands, is longitudinally displaceable. A slide, which supports the bearing specifying the swivel axis of the base plate (26), is additionally linearly displaceable (38).

21 Claims, 7 Drawing Figures

SUPPORTING DEVICE FOR A DATA DISPLAYING UNIT

The invention relates to a supporting device for a data display unit.

Such supporting devices are known in the form of swivel arms, one end of which is fastened to a work table so as to be rotatable about a vertical axis. The second end of the swivel arm carries, also so as to be rotatable about a vertical axis, a screen which can thus be swivelled on a circular path and aligned with the viewer in the respective position of the swivel arm.

Such supporting devices are sometimes not satisfactory since the setting of the distance between the screen and the user inevitably results in a lateral displacement of the screen.

It is therefore the object of the present invention to develop a supporting device as described herein in such a way that, with a specified viewing direction, it is possible to change the distance between the screen and a fixedly specified viewing location.

According to the invention, this problem is solved by a supporting device as described herein.

Advantageous further developments of the invention are given hereinafter.

With the further development of the invention it is possible to set also the viewing direction in accordance with the respective personal wishes, allowing the distance between the eye and the data display unit to be set for the viewing direction chosen. Both by swivelling the base part and by displacing the supporting part on the base part one can move the data display unit from the viewer's field of vision and work when it is not required. There then exist free visibility conditions; a person working with the data display unit does not feel "imprisoned" by the data display unit which is not required.

The guide provided for according to the invention also makes it possible to use a data display unit from several adjacent operating locations.

If provision is made for the guide on a separate side table, then the work tables, at which the persons working with the data display units sit, do not have to be modified.

With a further development of the invention it is possible to divide the side table either between two work tables which have been placed opposite to each other with their longitudinal edges or between two work tables abutting with their longitudinal edges, the side table abutting the narrow sides of the work tables in the last-mentioned case. In the case of the last-mentioned mode of erection, the data display unit can be additionally used from two further operating locations if two further work tables adjoin, with their narrow sides, the second longitudinal edge of the side table.

Further developments of the invention are of advantage with respect to a substantially continuous work surface.

In the case of a supporting device according to another embodiment, there do not lie on the work surface any cables leading to the data display unit.

The same advantage is obtained in the case of a supporting device according to another embodiment by a modem working without wire, as described hereinafter.

In the case of a supporting device according to another embodiment, one has a guide for displacing the base part without having to provide the work surface with an opening.

The further development according to the invention ensures that the supporting part can also be moved far away from the guide so that the centres of gravity of the supporting part and the data display unit are no longer above the guide, without tilting the data display unit considerably. Due to the additionally provided auxiliary bearing, the base part can still be swivelled when the base part is supported on the work surface while the supporting part is extended.

The further development of the invention according to the invention ensures that the slight tilting of the base part until the auxiliary bearing is placed on the work surface can occur in a steady and controlled manner, since the guide rollers can simultaneously assume the function of a self-aligning bearing.

The further development of the invention according to another embodiment is of advantage with respect to as large a base of the guide as possible and with respect to the easy producibility and high mechanical loadability thereof, since the work tables and the side tables are in any case stiffened by an additional frame on the edge of their work top.

With a further development of the invention it is possible to ensure the guidance of the base part simply by two work tables which have been put up with an appropriate spacing. If such chamfers, which are provided for with foresight, are provided on all edges of the table, then this table can very flexibly be combined with other work tables to form multiple work locations, any chamfers which are not required forming an attractive recess of the table top edge.

With a further development of the invention, it is possible to prepare work tables with a low expenditure for the task of guiding the base part, the guide obtained by two work tables which are opposite to each other at a distance also being capable of absorbing tilting torques.

If appropriate guide rails are provided on a work table so as to extend around the table top, then one again has a very great flexibility in the combination of multiple work locations, allowing any guide rails which are not required to be converted into ornamental strips by means of a profiled part inserted thereinto.

A further development of the invention ensures a fixed distance between the ends of the guide rails even on smooth floors, on which the work tables stand. In an arrangement according to claim 13, the spacers simultaneously form a shock-free flush transition between the opposite work tables.

If one additionally provides for a cover plate carried by the spacers according to another development, then one has a substantially continuous work surface between the two opposite work tables, too.

In the case of a supporting device according to another embodiment, it is possible, with the supporting part retracted, to use the section of the base part normally serving as an extension surface for the supporting part as an area for depositing a keyboard. This board can thus be moved, together with the data display unit, from the range of vision and work of a staff member and/or can be moved to another work location.

A further development of the invention is of advantage with respect to a mechanically simple construction of the supporting part guide and to easy fitting of the supporting part on the base part.

A further development of the invention ensures the locking in place of the base part and/or the supporting part in different work positions without using a brake. The guides thus do not have to be aligned exactly horizontally at the erection site.

Further developments of the invention are of advantage with respect to an effortless movement of the data display unit, even if the weight thereof is heavy and an electronic unit may have been placed beneath the data display unit. At the same time, it is ensured that the servo-drives do not constitute any accident hazard since the friction-wheel drives slip if an obstacle is encountered as the base part or the supporting part is adjusted.

Hereinafter, the invention will be explained in more detail with the aid of exemplified embodiments and with reference to the drawings, in which.

Figure 1:
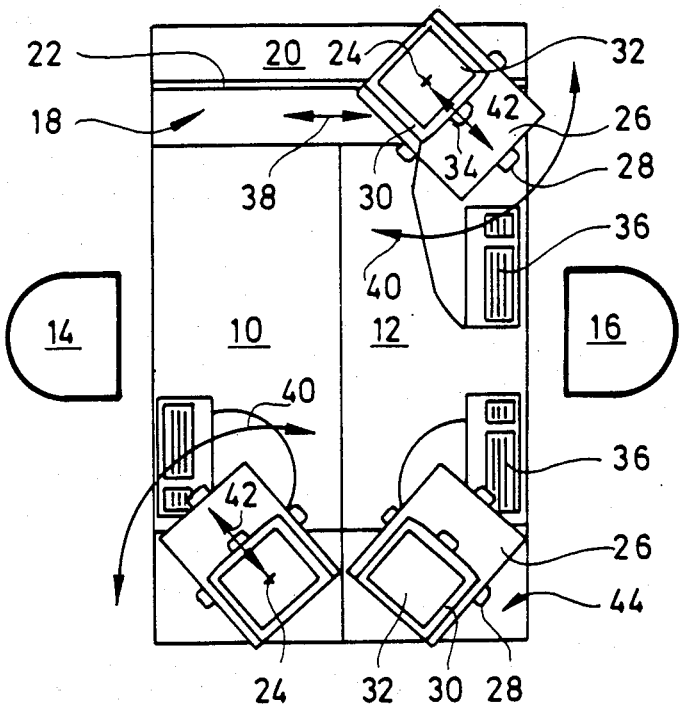
FIG. 1 shows a top view of a dual work location with three screens.

FIG. 1 shows two work tables 10, 12, which butt against each other with one longitudinal edge, as well as two chairs 14, 16 for the persons working at the work tables 10, 12.

Against one of the narrow sides of the work tables 10, 12 there butts a side table 18, whose length is equal to double the width of the work tables 10, 12.

The top 20 of the side table 18 is provided with a slot 22 which extends in the longitudinal direction and through which there extends a hollow shaft 24 (see FIG. 3) which is mounted in a manner that will be described in greater detail later and which can be moved along the slot 22. The hollow shaft 24 carries, in a freely projecting manner, a base plate 26 which is provided with handles 28 on the free front edge and on its side edges.

On the base plate 26 there is provided, guided longitudinally and in a manner that will be described in greater detail hereinafter, a supporting plate 30, on which there stands a screen 32 which is connected to a computer via cables not shown. A handle 34 on the front edge of the supporting plate 30 serves for moving the screen 32 towards and away from the viewer.

Data can be input into the computer via a keyboard 36. When the supporting plate 30 has been pushed back, there is room for the keyboard on the base plate 26 section which is then free and can then be moved and swivelled together with the screen.

In all, there exist the following possibilities of setting the viewing direction and the viewing distance between the operator and the screen 32: Displacing in the longitudinal direction of the side table 18, indicated by the double arrow 38; swivelling of the base plate 26 about the axis of the hollow shaft 24, indicated by the double arrow 40; moving the screen 32 towards and away from the viewer with a given viewing direction, indicated by the double arrow 42.

On the downwardly located narrow sides of the work tables 10, 12 in FIG. 1, there are provided further side tables 44, the length of which corresponds to the width of the work tables 10, 12 and which support, via base plates 26 and supporting plates 30 carried by stationarily mounted hollow shafts 24', further screens 32 which are adjustable in the direction of the double arrows 40 and 42.

One discerns that it is possible to swing the screens 32, together with the associated base plates 26 and supporting plates 30, completely away from the work surfaces of the work tables 10, 12. Both the viewing direction and the viewing distance can be set for each of the screens 32 in accordance with the respective wishes of the viewer. The upwardly located screen 32 in FIG. 1 can moreover be equally used from the two work locations, as desired, for example, during the test phase of programs, if an output terminal is temporarily required in addition to the programming terminal.

Due to the fact that one places against the upwardly located longitudinal side of the side table 18 in FIG. 1 two further work tables, abutting with their narrow sides, one can render possible the use of the screen 32 supported by the side table 18 from four work locations. If another work table is placed against the longitudinal edge of the side table 18 that is still free in FIG. 1, abutting with its longitudinal edge, then the upper screen in FIG. 1 can be used from three work locations.

Figure 2:
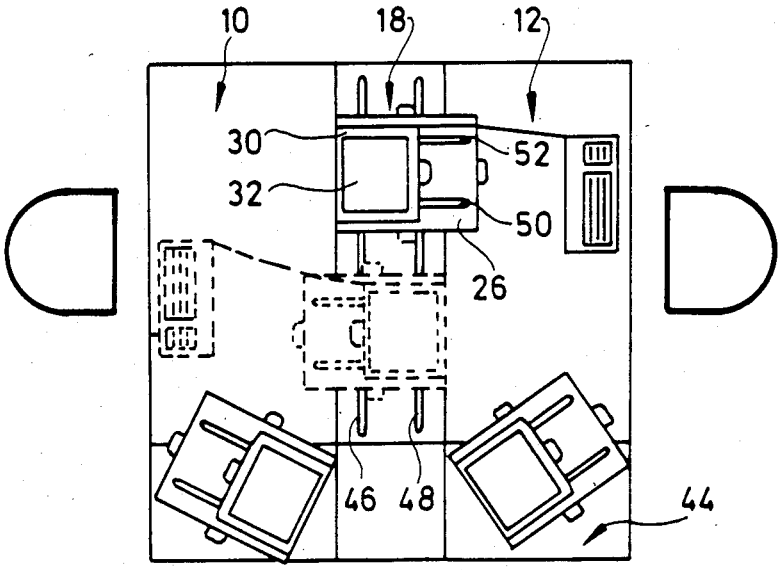
FIG. 2 shows a top view of a modified dual work location with three screens.

FIG. 2 shows a modified dual work location, wherein parts already illustrated with reference to FIG. 1 are provided with the same reference symbols. The side table 18 has now been inserted between the work tables 10, 12 so that the screen 32 supported by it can be used frontally both from the right-hand work location (solid lines) and from the left-hand work location (broken lines).

In the exemplified embodiment shown in FIG. 2, the side table 18 is provided, for guiding the base plate 26 in the longitudinal direction of the table, with two flat guide grooves 46, 48 which have a circular cross-section and in which guide rollers run, as will be described in more detail later with reference to FIG. 4. Similarly, the base plate 26 is also provided with two guide grooves 50, 52, in which guide rollers of the supporting plate 30 run.

Figure 3:
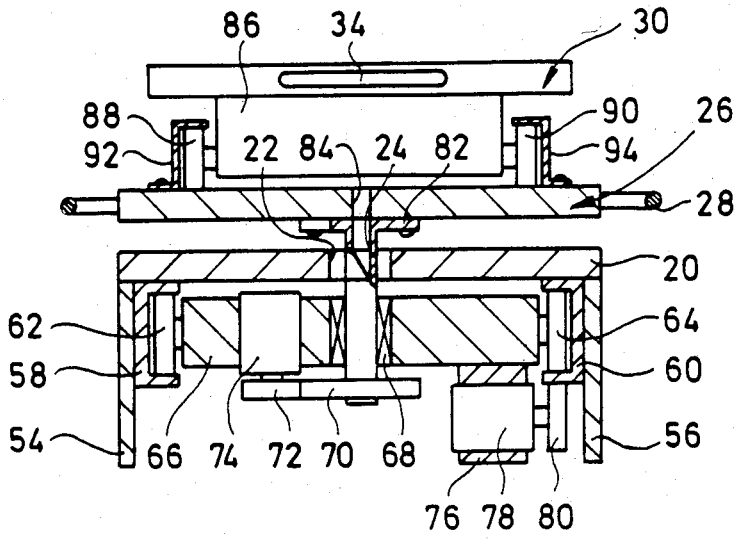
FIG. 3 shows a vertical section through a screen supporting device, such as is used at the dual work location shown in FIG. 1.

FIG. 3 shows details of the mounting of the base plate 26 on the side table 18 in the exemplified embodiment of FIG. 1:

Lateral cheeks 54, 56 are fixedly connected to the table top 20. Guide rails 58, 60, which have a U-shaped cross-section, are fixedly fitted, so as to be opposite to each other, to the cheeks and/or the table top 20. In the guide rails, there run two pairs of guide rollers 62, 64 which are fitted at a distance in the direction of movement and of which only one is respectively shown in FIG. 3. The guide rollers 62, 64 are mounted on a slide 66 which simultaneously forms the bearing housing for an axial/radial bearing 68, by which the hollow shaft 24 is carried.

An end section of the hollow shaft 24 taken beyond the underside of the slide 66 carries a friction wheel 70 which meshes with a friction wheel 72 which has a smaller diameter and is fitted on the driven shaft of an electric motor 74. The latter is energisable, via switches not shown, for clockwise or anti-clockwise rotation.

A suspended lug 76 of the slide 66 carries another electric motor 78, on the shaft of which there has been placed a friction wheel 80. The latter co-operates with the underside of the guide rail 60.

An upper flange 82 of the hollow shaft 24 has been screwed to the base plate 26 which has a passage 84 that is aligned with the passage of the hollow shaft 24. In this way, it is possible to feed from the underside of the side table 18 cables for connecting the screen and the keyboard to a computer without any cable loops forming on the top of the side table 18 when the base plate 26 is adjusted in the longitudinal direction of the guide rails 58, 60.

The supporting plate 30 has a suspended lug 86, on which guide rollers 88, 90 are mounted. The latter co-operate with angled guide rails 92, 94 which have been screwed to the top of the base plate 26.

Figure 4:
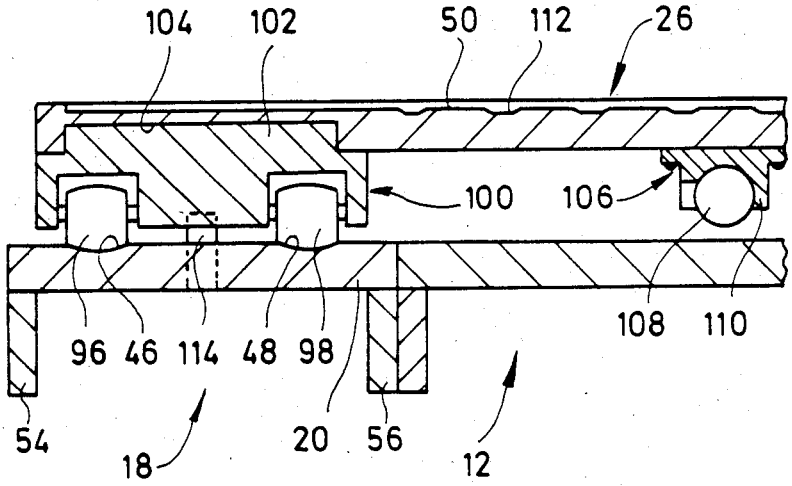
FIG. 4 shows a vertical section through a portion of a screen supporting device, such as is used at the dual work location shown in FIG. 2.

In the case of the modified screen supporting device shown in FIG. 4, which is also shown in FIG. 2, there run in the guide grooves 46, 48, which have a circular cross-section, in the top of the table-top 20 of the side table 18 guide rollers 96, 98, whose cross-section is complementarily circular and which are mounted in a slide 100.

On its top, the slide 100 is provided with a cylindrical peg section 102, which has a large diameter and engages with a sliding fit in a bearing recess 104 provided in the underside of the base plate 26.

On its underside, the base plate 26, in the vicinity of its free end, is provided with an auxiliary bearing which is designated 106 as a whole and comprises a ball 96, and which has a large diameter and consists of low-friction plastics material, and a slotted ball cup 110 which also consists of low-friction plastics material. The height of the auxiliary bearing 106 has been dimensioned to be such that the ball 108 is at a short distance from the top of the work table 10 or 12 and from the top of the side table 18 when the guide roller pairs 96, 98 both snugly stand in the guide grooves 46, 48 under the weight of the screen standing above the slide 100.

The supporting plate 30, which is not shown in detail, of FIG. 4 is similar in design to that shown in FIG. 3 and runs with its guide rollers 88, 90 in the guide grooves 50, 52 in the top of the base plate 26. If the supporting plate 30 is pulled away from the slide 100 to such an extent that the centre of gravity of the supporting plate and the screen comes to lie outside the guide rollers 98 (in the angular position of the base plate 26 shown in FIG. 4 and during the movement to the right in the drawing), then the slide 100 is slightly tilted about an axis specified by the centre of curvature of the guide groove 48 and the ball 108 comes into abutting contact with the top of the work table 12. Even when the supporting plate 30 is extended in this way, it is possible to continue to move the base plate 26 in the longitudinal direction of the guide grooves 46, 48 or to rotate it about the axis of the peg section 102, there being now provided a three-point bearing via the two guide rollers 96 and 98 and the ball 108. If the supporting plate 30 is moved again above the slide 100, then the slide 100 is slightly tilted in the opposite sense and the guide rollers 96 and 98 come again into snug abutting contact with the guide groove 46 and 48.

As can be seen in FIG. 4, the guide grooves 50, 52 are provided with a plurality of small depressions 112, into which the guide rollers 88, 90 can run. In this way, one obtains a locking in place of the supporting plate 30 and the screen 32 under their own weight in different working positions so that a parking brake is not necessary even if the slide 100 is slightly tilted. The guide grooves 46, 48 can correspondingly also be provided with depressions so as to hold the guide slide 100 in a desired working position, without a parking brake, even if the mounting surface for the side table 18 is slightly inclined.

One discerns that, in the cases of the supporting device shown in FIG. 4, too, the screen can be easily set for the viewing direction and the viewing distance, and this in respect of several adjacent work locations. One discerns furthermore that after removing the screen 32, the supporting plate 30, the base plate 26 and the slide 100 one has a continuous work surface. Dirt can be easily removed from the guide grooves 46, 48 since they do not have any sharp offset edges.

If the guide grooves 46, 48 are not continued until the end of the side table 18, as shown in FIG. 2, then its ends form obstacles limiting the displacement path of the slide 100. If desired, the guide grooves 46, 48 may however be frontally open so as to allow the slide 100 to be moved on an alignedly mounted further side table. In this case, there are then embedded into the table top 20, for limiting the displacement path, stop pins 114 which project into the track of the slide 100.

Figure 5:
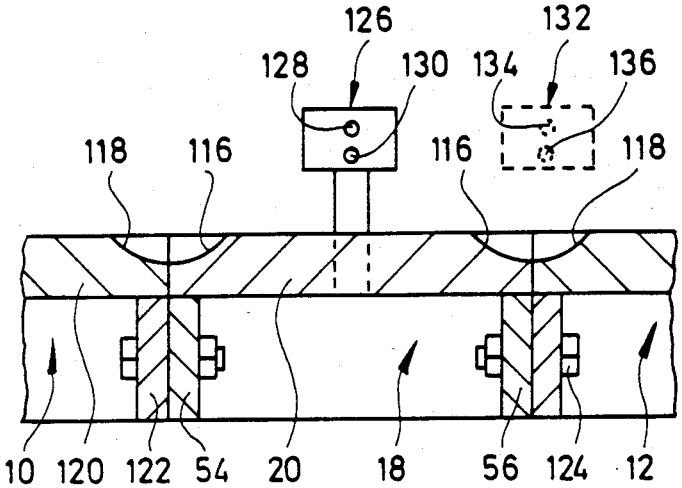
FIG. 5 shows a vertical section through a portion of a further modified guide for a screen supporting device.

FIG. 5 shows a modified arrangement of guide grooves which result in a wider base and a higher mechanical supporting capacity. The table top 20 of the side table 18 is provided with circular chamfers 116 on its longitudinal edges, and corresponding chamfers 118 are present on the longitudinal edges of the tops 120 of the work tables 10 and 12. Cheeks 122 of the latter are connected by bolts 124 to the cheeks 54, 56 of the table top 20 so that the side table 18 does not need any feet of its own.

The chamfers 116, 188 thus together form circular guide grooves which are comparable to the guide grooves 46, 48 and in which a slide 100 can run with guide rollers 96, 98 in exactly the same way as in the exemplified embodiment shown in FIG. 4.

In order to keep the work surface without openings in the exemplified embodiment shown in FIG. 5 clear of trailing cables, there is carried by the stop pin 114 a modem part 126 which is set back and which has an IR laser diode 128 as the transmitting part and a photodiode 130 responding to infra-red light as the receiving part. The axes of the laser diode 128 and of the photodiode 130 extend parallel to the guides formed by the chamfers 116, 118. A corresponding second modem part 132, which is carried by the slide 100 so as to be aligned with the first modem part 126, has a photodiode 134, which is aligned with the laser diode 128, and an IR laser diode 136 which is aligned with the photodiode 130. The transmission channels from and to the slide 100 operate in known manner with different fundamental frequencies so as to avoid any cross-viewing. The data transmission between the slide 100 and the screen 32 and the keyboard 36 is effected by cable.

The wireless data transmission between the slide 100 and the computer as shown in FIG. 5 may be equally used for the supporting device shown in FIG. 4.

Figure 6:
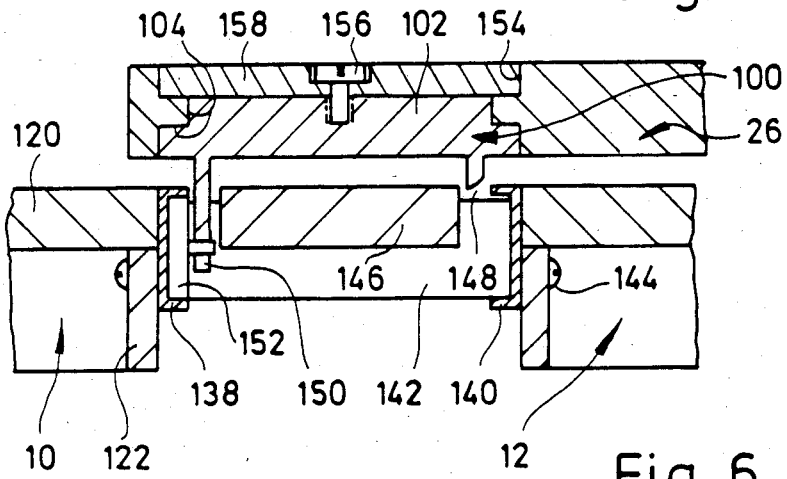
FIG. 6 shows a vertical section through a portion of a further modified screen supporting device.

In the case of the further modified screen supporting device shown in FIG. 6, there are fastened to the table tops 120 and/or the cheeks 122 of the work tables 10, 12 guide rails 138, 140, which have a U-shaped cross-section, so as to be aligned with each other. At the ends of the guide rails 138, 140, there have been inserted thereinto in an interlocking manner spacer parts 142 which ensure a specified distance between the work tables 10 and 12 and are fixedly connected to the work tables by screws 144. The two spacer parts 142, for their part, carry a cover plate 146 which is a flush continuation of the table tops 120 but, in the vicinity of the guide rails 138, 140, leaves respectively a narrow passage 148, through which lugs 150 of a modified slide 100 have been passed, which lugs carry guide rollers 152.

Since the guide rails 138, 104 can also absorb tilting moments about an axis that is perpendicular to the drawing plane, the articulated connection between the base plate 26 and the slide 100 is also designed for the transmission of corresponding torques. To this end, the bearing recess 104 is provided with a counter hole 154, in which a support disc, which is fixedly connected to the peg section 102 by a screw 156, sits in a flush manner. The guidance of the supporting plate 30 on the base plate 26 is not shown in detail and can be effected as in one of the previously described exemplified embodiments.

Figure 7:
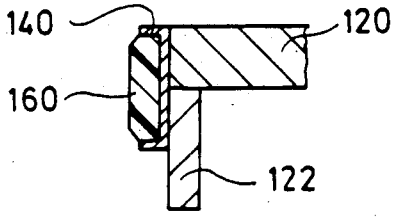
FIG. 7 shows a vertical section through an unused guide rail fitted to a work table and provided with an inserted plastics material strip.

Since inexpensive extruded profiles can be used for the production of the guide rails 138, 140, the guide rails can as a rule be fitted to system work tables which are intended for being combined to form multiple work locations. If the guide rails 138, 140 are not used for guiding a slide supporting a screen, there is inserted thereinto in a form-locking manner an ornamental profile 160, as shown in FIG. 7. Such ornamental profiles can be produced from plastic material or genuine wood.

What is claimed is:

1. A supporting device for a data display unit, which device is provided with a supporting part which is rotatable about a vertical axis and is displaceable in a horizontal plane and on which the data display unit can be placed, characterized in that the supporting part (30) is guided so as to be longitudinally displaceable on a base part (26) which, for its part, is connected via an axial/radial bearing (68; 102, 104) having a vertical axis to a piece of furniture (10, 12; 18; 44) provided with the supporting device, said axial/radial bearing being fitted on a slide (66; 100) which runs on a guide (46, 48; 58, 60, 116, 118; 138, 140) which is formd on a side table (18) or on two work tables (10, 12) which are opposite to each other at a distance.

2. A supporting device as claimed in claim 1, characterised in that the guide for the slide (66) is arranged on the underside of the table top (20) of the side table (18) and a shaft (24) carrying the base part (26) has been passed through a longitudinal slot (22) in this table top (20).

3. A supporting device as claimed in claim 2, characterised in that the shaft (24) is a hollow shaft and the base part (26) has a passage (84) which is aligned with the shaft interior.

4. A supporting device as claimed in claim 1, characterised in that the slide guide is formed by guide rails (138, 140) which are fixedly fitted to the facing parallel sides of two work tables (10, 12).

5. A supporting device as claimed in claim 4, characterised by spacer parts (142) which extend at the ends of the guide rails (138, 140) between the work tables (10, 12) and which are fixedly connected to the work tables (10, 12).

6. A supporting device as claimed in claim 5, characterised in that the spacer parts (142) are flush with the front ends of the guide rails (138, 140) and sit in the guide rails (138, 140) in an interlocking manner.

7. A supporting device as claimed in claim 5, characterised in that the spacer parts (142), for their part, carry a cover plate (146) which shuts the space between the guide rails (138, 140) with the exception of two slots (148) extending in the rail longitudinal direction, and in that the rollers (152) of the slide (100) are mounted on lugs (150) of the slide (100) which engage through these slots (148) with a clearance.

8. A supporting device as claimed in claim 4, characterised by ornamental profiles (160) which are inserted in an interlocking manner in unused guide rails (140) of a work table (10, 12).

9. A supporting device as claimed in claim 1, characterised by a wireless modem (126, 132) for data transmission between the slide (100) and the piece of furniture (18), which modem has a first modem part (126), equipped with a receiver (130) and a transmitter (128), with directional characteristics extending parallel to the slide guide, and a second modem part (132), equipped with a receiver (134) and a transmitter (136), with directional characteristics aligned with the directional characteristics of the first modem part (126), the first modem part (126) being carried by the piece of furniture (18) and the second modem part (132) being carried by the slide (100).

10. A supporting device as claimed in claim 1, characterised in that the base part (26) is designed as a plate.

11. A supporting device as claimed in claim 10, characterised in that the guide between the base part (26) and the supporting part (30) is formed by guide grooves (50, 52) formed in the base plate top or by guide ribs which co-operate with guide rollers (88, 90) which are matched therewith and are mounted on the supporting part (30).

12. A supporting device as claimed in claim 1, characterised by a friction wheel drive (70-74) which operates the rotatable part of the axial/radial bearing (64) and is supported by the slide (66).

13. A supporting device as claimed in claim 1, characterised by a friction wheel drive (76-80) which is supported by the slide (66) and acts on the slide guide (58, 60) or a surface of the piece of furniture (18) that is parallel to the direction of movement of the slide (66).

14. A supporting device for a data display unit, which device is provided with a supporting part which is rotatable about a vertical axis and is displaceable in a horizontal plane and on which the data display unit can be placed, characterized in that the supporting part (30) is guided so as to be longitudinally displaceable on a base part (26) which, for its part, is connected via an axial/radial bearing (68; 102, 104) having a vertical axis to a piece of furniture (10, 12; 18; 44) provided with the supporting device, said axial/radial bearing being fitted on a slide (66; 100) which runs on a guide (46,48; 58, 60, 116, 118; 138, 140) which is formed on a side table (18) or on two work tables (10, 12) which are opposite to each other at a distance, said guide for said slide being formed by two guide grooves (46, 48; 116, 118) or guide ribs in the tops of the side table (18) and the work tables (10, 12) at a transversal interval and on which there run rollers (62, 64; 96, 98) mounted on the slide (66; 100).

15. A supporting device as claimed in claim 14, characterised in that the base part (26), in its section projecting beyond the guide, is provided with an auxiliary bearing (106) which is a short distance from the top of the work table (10, 12) when the supporting part (30) is placed above the slide (100).

16. A supporting device as claimed in claim 15, characterised in that the guide grooves (46, 48; 116, 118) and the rollers (96, 98) of the slide (100) which are complementary thereto are circular in cross-section.

17. A supporting device as claimed in claim 15, characterised in that the guide grooves are formed by chamfers (116) provided on the longitudinal edges of the side table (18).

18. A supporting device as claimed in claim 15, characterised in that the guide grooves are formed by chamfers (118) of opposite work tables (10, 12).

19. A supporting device as claimed in claim 14, characterised in that the guide grooves (46, 48; 50, 52) or guide ribs are provided with depressions (112) which are consecutive at intervals.

20. A supporting device for a data display unit which comprises in combination (a) a supporting member (30) upon which the display unit can be placed, (b) a base member (26) positioned beneath said supporting member (30), (c) a first, longitudinally extending guide means located intermediate said supporting member (30) and said base member (26) so that said supporting member (30) can be longitudinally displaced with respect to said base member (26), (d) a table (10, 12, 18, 24) positioned beneath said base member (26), (e) vertical axial support means (24, 68, 102, 104) to support said base member (26) with respect to said table (10, 12, 18 24) on a vertical axis so that said base member (26) can be rotated through a horizontal plane about said vertical axis, and (f) means to support said vertical axial support means on a slide (66, 100) which is adapted to run along a second longitudinally extending guide means (46, 48, 58, 60) that is connected to said table (10, 12, 18, 24) so that said vertical axial support means can move longitudinally with respect to said table (10, 12, 18,24).

21. A supporting device according to claim 20 wherein said second longitudinal extending guide means being in the form of guide grooves or guide ribs provided adjacent the tops of said table (10, 12, 18) at spaced apart intervals on which there run rollers (62, 64, 96, 98).

* * * * *